US008723686B1

(12) United States Patent
Murray et al.

(10) Patent No.: US 8,723,686 B1
(45) Date of Patent: May 13, 2014

(54) AUTOMATED DATALINK ALERT AND ALTERNATE ADVISORY SYSTEM

(75) Inventors: Gregory D. Murray, Houston, TX (US); Kirschen A. Seah, Cedar Rapids, IA (US); Alan E. Siniff, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 100 days.

(21) Appl. No.: 13/563,649

(22) Filed: Jul. 31, 2012

(51) Int. Cl.
*G08G 1/00* (2006.01)

(52) U.S. Cl.
USPC ..... 340/901; 340/903; 340/905; 340/945; 340/970; 340/973; 340/995.1; 342/179; 342/182; 701/532; 701/538

(58) Field of Classification Search
CPC ..... G01C 23/00
USPC ..... 340/901, 903, 905, 945, 970, 973, 340/995.1; 342/179, 182; 701/532, 538
See application file for complete search history.

(56) References Cited

U.S. PATENT DOCUMENTS

| | | | | |
|---|---|---|---|---|
| 5,111,400 | A | 5/1992 | Yoder | |
| 5,265,024 | A | 11/1993 | Crabill et al. | |
| 6,014,606 | A | 1/2000 | Tu | |
| 6,995,686 | B2 * | 2/2006 | Gosdin et al. | 340/905 |
| 7,027,898 | B1 * | 4/2006 | Leger et al. | 701/14 |
| 7,081,834 | B2 * | 7/2006 | Ruokangas et al. | 340/945 |
| 7,437,225 | B1 | 10/2008 | Rathinam | |
| 7,612,688 | B1 | 11/2009 | Vigeant-Langlois et al. | |
| 2002/0039072 | A1 | 4/2002 | Gremmert et al. | |
| 2011/0291861 | A1 | 12/2011 | Meunier et al. | |

* cited by examiner

*Primary Examiner* — Tai T Nguyen
(74) *Attorney, Agent, or Firm* — Donna P. Suchy; Daniel M. Barbieri

(57) ABSTRACT

A method of managing an aircraft in flight may include electronically monitoring for a presence of a threat object along a flight path of the aircraft and at a destination airport of the aircraft, and electronically generating an alert when the presence of the threat object is detected. The alert may include information enabling air traffic control (ATC), flight dispatch, and a pilot of the aircraft to make a collaborative flight path correction decision that may prevent the aircraft from being affected by the threat object.

16 Claims, 8 Drawing Sheets

| | |
|---|---|
| **Aircraft No:** | N510QS |
| **Message ID:** | TXT-16187 |
| **Received at:** | 02/27/2012 19:23:32Z |
| **Message Type:** | Text Message |
| **Direction:** | Up |
| **TripID:** | |
| **Position:** | |
| **Status:** | Complete |

Message: TO: N510QS
FROM: RCFIS
Subject: WEATHER ALERT THRESHOLD MET
Message: N510QS
CAPT ANDERSON
KHPN WEATHER ALERT THRESHOLD MET OR EXCEEDED
CURRENT WEATHER
KHPN 271956Z 18009KT 10SM SCT110 11/00 A3013
FORECAST
KHPN 2321/2418 23011G18KT P6SM SCT050 BKN250
FM240000 23005KT P6SM BKN250
FM240200 19006KT 3SM -RA BR BKN008
TEMPO 2403/2410 1SM -RASN OVC004
AVAILABLE ALTERNATES KPHL KBDL
TKS/ARC

FIGURE 3

AUTOMATED DATALINK ALERT AND ALTERNATE ADVISORY SYSTEM

BACKGROUND

During flight it is incumbent upon the pilot or flight dispatch (or flight following ground service) to keep track of information pertinent to the flight including, for example, weather at destination airport and weather to be encountered en route to the destination airport, destination airport conditions, aircraft performance, temporary flight restrictions, fuel availability, conditions at and availability of alternate airports in the vicinity of the destination and/or of the flight path. During the flight, workload may prevent the pilot from keeping track of current weather and other conditions/events (such as the above) that affect the flight. For example, if weather at the destination drops below certain ILS (Instrument landing system) minimum levels, the pilot and/or dispatch must determine a useable achievable alternate airport within a short period of time, or in some cases with no notice. Similarly, if a NOTAM (Notices To Airmen) is issued indicating the destination airport as being closed, the pilot and/or flight dispatch have little or no time to determine an alternate useable airport.

Further, determining an alternate airport suitable for rerouting is not a trivial task. It involves gathering and processing a great deal of information which, on present flight decks, is scattered in various locations on the flight deck and/or obtained from multiple communications with the ATC (Air Traffic Control) and/or dispatch. For example, it may be necessary to verify whether the alternate airport is open, has acceptable weather conditions, is ILS operative, has customs facility available, etc. Due to the complexities of choosing an alternate airport, it may be a best guess as to which alternate airport to choose.

Regulatory agencies such as the Federal Aviation Administration (FAA) and EuroControl are starting to consider Collaborative Decision Making (CDM) concept amongst flight dispatch, pilot, and air traffic control. However, as mentioned above, present day flight decks scatter in many places the information which the pilots need to evaluate, understand, and participate in such a collaborative environment.

As such, there is a need for a system that monitors and evaluates events that impede normal and/or safe flight operation and determines solutions to avoid encountering such impeding events, such that the pilot, the ATC and/or the flight dispatch workload in determining the solutions is minimized.

SUMMARY

Embodiments of the disclosure may provide a method of managing an aircraft in flight. The method may include electronically monitoring for a presence of a threat object along a flight path of the aircraft and at a destination airport of the aircraft, and electronically generating an alert when the presence of the threat object is detected. The alert may include information enabling air traffic control (ATC), flight dispatch, and a pilot of the aircraft to make a collaborative flight path correction decision that may prevent the aircraft from being affected by the threat object.

Embodiments of the disclosure may further provide a system for managing an aircraft in flight. The system may include at least one database configured to store and update information required to safely operate the aircraft, and an alert and alternate advisory system communicably coupled to the database. The alert and alternate advisory system may be configured to continuously query the database for a threat object along a flight path of the aircraft and at a destination airport of the aircraft, and to issue an alert to air traffic control (ATC), flight dispatch, and a pilot of the aircraft when the presence of a relevant threat object is detected. The alert may include information permitting the ATC, the flight dispatch, and the pilot of the aircraft to make a collaborative decision that may prevent the aircraft from being affected by the identified threat object. The identified threat object may be an impediment to normal or safe flight operation.

Embodiments of the disclosure may further provide a method of managing an aircraft in flight. The method may include implementing, in an automated alert and alternate advisory system, at least one rule defining one or more conditions that must be satisfied in order to safely operate the aircraft. The one or more conditions may be pertinent to one or more identified relevant threat objects along a flight path of the aircraft or at a possible destination airport of the aircraft. The method may further include issuing, using the automated alert and alternate advisory system, an alert to air traffic control (ATC), flight dispatch, and a pilot of the aircraft when the one or more conditions defined by the at least one rule are not satisfied. The alert may include information enabling the ATC, the flight dispatch, and the pilot of the aircraft to make a collaborative decision that may prevent the aircraft from being affected by an identified relevant threat object.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

FIG. 3 illustrates an example datalink weather alert, according to exemplary embodiments.

DETAILED DESCRIPTION

Figure 1:
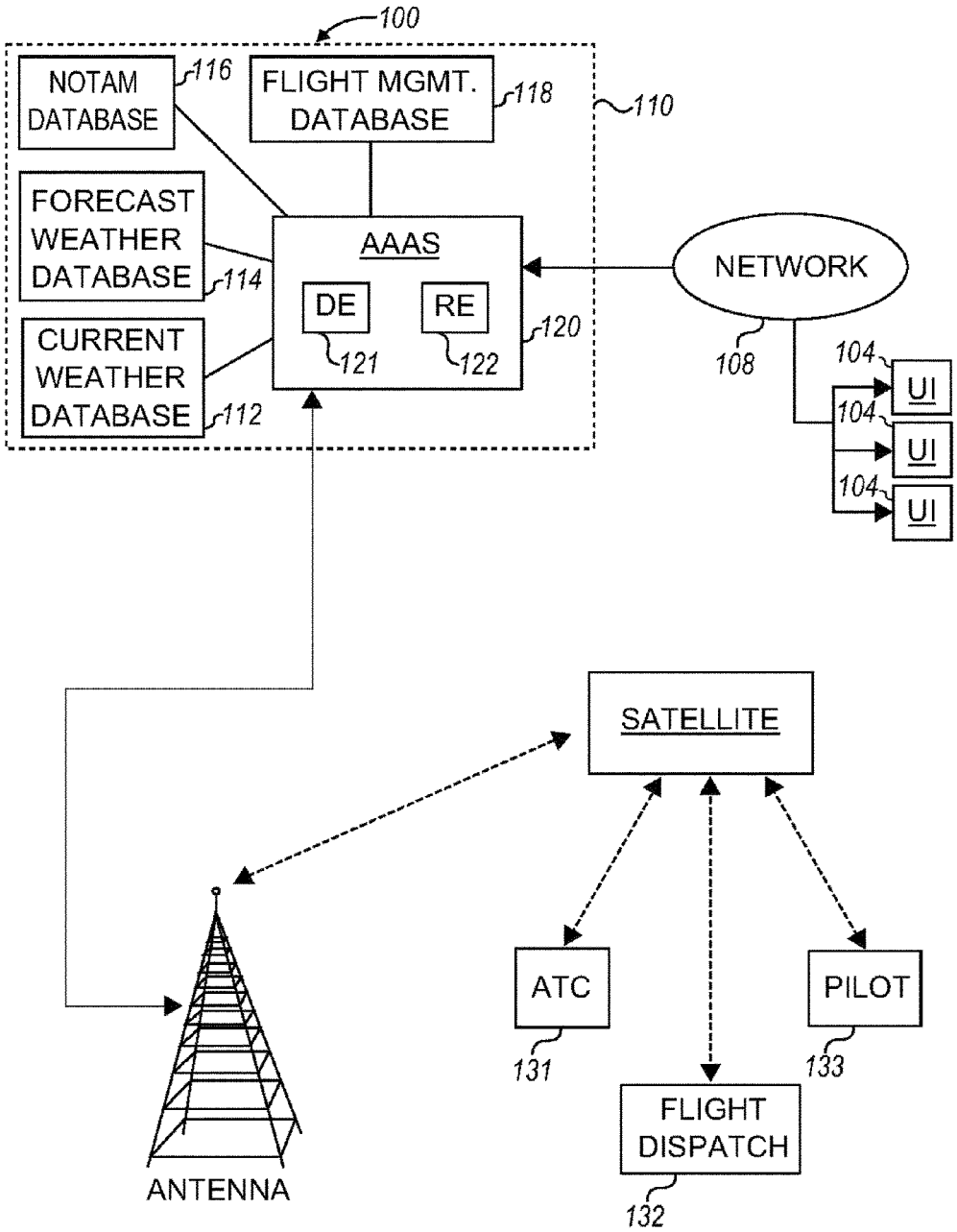
FIG. 1 illustrates an aircraft management system, according to exemplary embodiments.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Referring now to FIG. 1, illustrated is an exemplary aircraft management system 100, according to embodiments of the disclosure, that includes at least one database 112, 114, 116, and 118 configured to store and update air travel related data, and an Alert and Alternate Advisory System (AAAS) 120 communicably coupled to the at least one database 112, 114, 116, and 118. The AAAS 120 and the at least one database 112, 114, 116, and 118 may be conveniently housed in a central location, such as an Operational Center (OC) 110, which is generally maintained by a flight operations service provider. For example, as shown in FIG. 1, the AAAS 120 may be communicably coupled to a current weather database 112, a forecast weather database 114, a NOTAM database 116, and a flight management database 118. Various air travel related data may be stored within each of the databases 112, 114, 116, and 118. For example, current weather database 112 may include, in the form of METARs or other information, data such as current weather at airports around the world, at the destination airport, at points along the flight path to the destination airport and/or at a specific location. Forecast weather database 114 may include, in the form of TAFs or other information, weather forecast at airports around the world, the destination airport, at points along the flight path and/or at a specific location. NOTAM database 116 may include notices and/or advisories created and transmitted by Civil Aviation Authorities (for example, Federal Aviation Administration, (FAA)) and/or airport operators to alert aircraft pilots of any hazards. Although the OC 110 is illustrated to house the AAAS 120 and the databases 112, 114, 116, and 118, according to exemplary embodiments, a portion of the databases and a portion of the AAAS 120 (including, for example, rules, decision support algorithms, and alerting (detailed below)) may be implemented as part of the aircraft's inflight avionic system in order to provide autonomous decision making.

The flight management database 118 may include information about various flight management services, such as flight conditions, aircraft capabilities, flight risks, crew capabilities, concierge services, flight plans, conditions at the destination airport, conditions at the alternate airports, airport specifications/information, business rules, and/or political issues. The flight management database 118 may include the aforementioned information about airports around the globe. This information may be monitored and/or updated continuously. The contents of the flight management database 118 may be held in an individual database or may be stored collectively in multiple databases. In alternative embodiments, however, the OC 110 may include other databases configured to fit the particular application.

The current weather database 112 and the forecast weather database 114 may include weather data, such as lightning, icing, rain, hail, snow, fog, turbulence, volcanic ash, wake turbulence, SLD (Super-cooled Large Droplet), and/or other conditions that represent a particular hazard to aircraft. The information stored in the current weather database 112 and/or the forecast weather database 114 may be automatically pulled and processed by the AAAS 120 when requested.

The NOTAM database 116 may include the NOTAMs issued for a variety of reasons including, but not limited to, hazards such as air-shows, parachute jumps, kite flying, rocket launches, Temporary Flight Restrictions (TFRs), closed runways/taxiways, inoperable radio navigational aids, military exercises with resulting airspace restrictions, inoperable lights on tall obstructions, temporary erection of obstacles near airfields (e.g. cranes), passage of flocks of birds through airspace (a NOTAM in this category is known as a BIRDTAM), notifications of runway/taxiway/apron status with respect to snow, ice and standing water (a SNOWTAM), notification of an operationally significant change in volcanic ash or other dust contamination (an ASHTAM) or the like. The information stored in the NOTAM database 116 may be automatically pulled and processed by the AAAS 120 when requested.

The flight management database 118 may be a cluster of databases including the aforementioned information or may be a single database including the aforementioned information. The information stored in the flight management database 118 may be automatically pulled and processed by the AAAS 120 when requested. The flight conditions in the flight management database 118 may include conditions relevant to or being experienced by the aircraft (on ground or in flight). These may include, for example, location of aircraft (latitude/longitude), altitude, attitude, speed, flight path, outside air temperature (OAT) or static air temperature (SAT), fuel quantity, maintenance status, congestion, or the like.

The aircraft capabilities included in the flight management database 118 may include manufacturer-supplied aircraft information relating to a plurality of different aircraft. The manufacturer-supplied aircraft information may include fuel burn information for the various aircraft. The aircraft information may also include whether the aircraft is Instrument flight rules (IFR) and/or visual flight rules (VFR) capable, various instrument landing system (ILS) categories the aircraft is certified for, types of brakes and thrust reversers of the aircraft, whether the aircraft is equipped with anti-icing equipment, or the like.

The crew capabilities included in the flight management database 118 may include, for example, crew certifications, crew experience, crew preferences, crew training, crew rest schedule, duty hours or the like. Flight risks may include any potential or perceived conditions that may affect aircraft operation at the origin or destination airports or en route. For example, in a war zone, unknown to the pilots, a desired flight path may approach a missile installation or any similar hazard. Concierge services may include the support services on the ground for crew and passengers, archived and/or current pricing details for each air flight service from a plurality of vendors at airports around the world. The various third-party air flight services may include acquiring landing permits for the destination airport, acquiring overflight permits, scheduling slots, air navigation services for landing/approach, providing customs services upon reentering the U.S. including reporting Advanced Passenger Information System (APIS) required documentation, ground handling arrangements or flight following services, arranging for hotel reservations in foreign or domestic countries, providing ground transportation services, providing localized weather forecasts and forecasting services, catering services, flight supervision services, basic air flight crew and air flight crew transportation services, parking services, and developing and filing a flight plan with the local Civil Aviation Authority (e.g. FAA in the USA).

The conditions at destination airport and/or conditions at alternate airport may include airport latitude/longitude data, available runway information, available gate information, airport contact information, available fuel suppliers and vendors, available airport services, ground handling services, luggage handling capabilities, available maintenance services, available navigation aid information, or the like. As can be appreciated, however, other types of airport-related data can be stored and provided in the flight management database 118 to fit the particular application.

The political issues involved may include overflight charges, passport/visa requirements, various taxes and fees imposed by the airport and/or governments. The political issues may also include, for example, political instability in a country, security issues as a result of the political situation, or the like. The business rules may be customers specific, and may include, for example, aircraft speed desired during flight (go fast or slow), turbulence avoidance (avoid at all times or minimize impact of turbulence), on-board entertainment, or the like.

The AAAS 120 is communicably coupled to the Air Traffic Control (ATC) 131, the flight dispatch (or flight following ground service) 132, and/or the pilots 133. This communication is generally bi-directional, and each of the ATC 131, flight dispatch 132, and pilots 133 can communicate with the AAAS 120 and with each other.

The AAAS 120 may include a software Data Engine (DE) 121 for accessing, compiling and processing the various data structures stored in the databases 112, 114, 116, and 118. The DE 121 may be communicably connected to the databases 112, 114, 116, and 118 and may include a plurality of decision support tools which process the input data from the databases 112, 114, 116, and 118. A result of the processing may be an alert that may be output to the ATC 131, flight dispatch 132 and/or pilots 133. The ATC 131, flight dispatch 132 and/or pilots 133 may collaborate with each other in order to take an appropriate action on the alert. Such an action may, for example, include updating the trajectory of the aircraft in flight. As explained below, the alert is based on defined rules.

According to exemplary embodiments, the alert may include an indication of what caused the alert, for example, weather, NOTAM, etc. The alert may also include suggested or possible alternate airports to which the aircraft may be rerouted based on distance, fuel, flight conditions, etc. In addition, the alert may also include a reason why the specific airports were suggested as alternatives. Since the AAAS 120 has access to airports and conditions prevailing at the respective airports, the AAAS 120 may evaluate the conditions at the airports and suggest alternate airports having acceptable conditions based on predetermined criteria that may be inputted by the crew or flight managers (generally prior to flight), or alternatively, preprogrammed into the system based on general flight safety preferences/parameters. Further, the alternate airports are selected based on rules, as detailed below.

According to exemplary embodiments, the alert may be in a textual form (FIG. 3) or other data transmission form, and may be transmitted to a specific aircraft via a datalink and decoded onboard by AAAS 120. The AAAS 120 may include a render engine (RE) 122 that is configured to process and/or decode the datalink alert to convert the datalink alert into a graphic representation that may be displayed on one or more of the flight deck displays illustrated in FIGS. 2A and 2B. The RE 122 may also be configured to generate a graphical representation of other information requested from or provided to the AAAS 120.

Figure 2A:
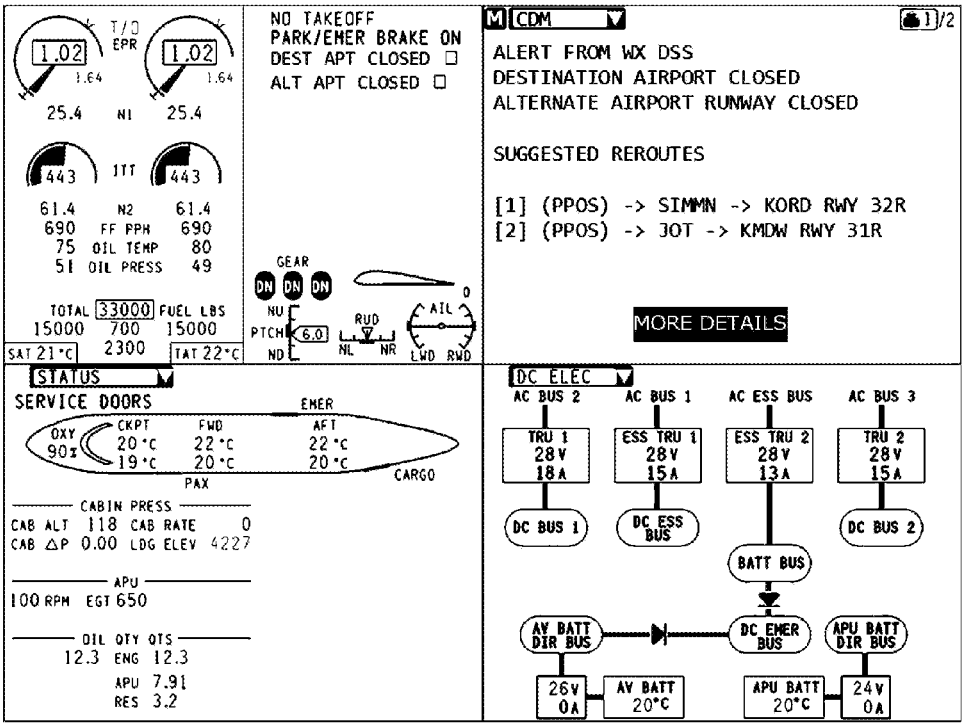
FIGS. 2A and 2B illustrate a flight deck display, according to exemplary embodiments.
Figure 2B:
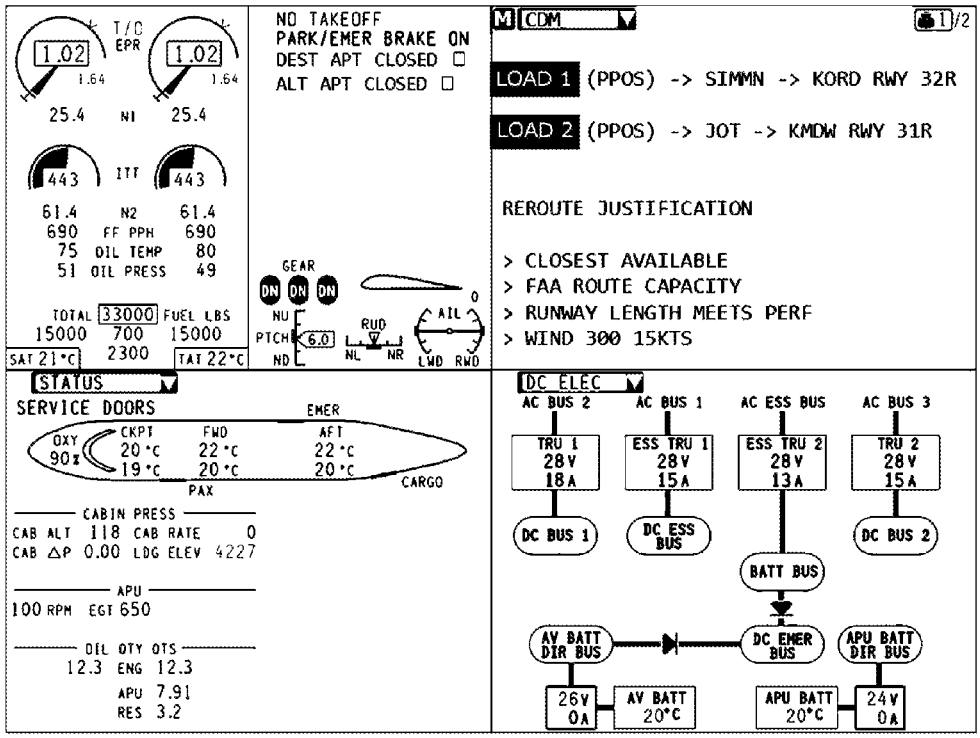

FIGS. 2A and 2B illustrate an exemplary flight deck display according to embodiments of the disclosure. As illustrated in FIGS. 2A and 2B, the flight deck display may be assumed to be divided into quadrants. It should be noted that the quadrant based layout is only an example and the flight desk may display information using other different types of layouts. Each quadrant may be divided further, and may display different information related to flight and/or aircraft.

For example, as illustrated in FIG. 2A, an alert is displayed in a portion of the upper left quadrant indicating that the destination airport is closed (DEST APT CLOSED). The pilot may then select the alert using an input device, such as a trackball or a track pad or if the display is a touch-screen display, the pilot may select the alert by touching the display screen. Selecting the alert may populate the upper right corner quadrant of the flight display. As illustrated, the display in FIG. 2A indicates that the alert has been received from a weather decision support system (WX DSS), which may be a part of the decision support tools of the DE 121. The alert indicates that the destination airport is closed and that the alternate airport is runway is closed.

The alternate airport is determined by the DE 121 using the rules based on the inputs from the databases 112, 114, 116, and 118. For example, the DE 121 continuously queries the databases 112, 114, 116, and 118 and, as per the rules defined, determines alternate airports suitable for an aircraft in flight to land. This determination is done based on the current flight conditions, aircraft capabilities, crew capabilities, political issues and business rules, flight plans, or the like that are defined in the rule. If during one such query of the NOTAM database, a NOTAM is discovered as having been issued indicating that the suitable alternate airport runway is closed, the DE 121 will query the databases 112, 114, 116, and 118, and per the rules defined, to determine the next best alternate airport to land. Accordingly, the suggested reroutes are transmitted to the aircraft and displayed. The reroutes indicate the next best airports determined based on the rule. The reroutes may also indicate the runway suitable for landing. When the pilot selects the "MORE DETAILS" option, the display in the upper right corner quadrant may change to the display illustrated in FIG. 2B.

The flight display in FIG. 2B gives the pilot the option to load the suggested reroutes into the flight computer via the options LOAD 1 and LOAD 2. The DE 121 also provides the pilots the justification (or the reasons) of choosing the displayed suggested reroutes. For example, as illustrated in FIG. 2B, the reroute airports are suggested because the airports are the closest available (determined based on fuel on board the aircraft, for example), the FAA route capacity permits landing at these airports, the runway is of a length that is preferred for landing the particular aircraft, and the wind speed and direction are suitable. Again, these suggestions are as per defined in the rule. The justification may also be based on whether the reroute airports have the capacity and facilities to handle the aircraft. The pilot may then reroute the aircraft to one of the suggested reroutes.

As mentioned above, an alert from the AAAS 120 may be sent to an aircraft via a datalink. In this manner, specific aircrafts can be targeted by the flight managers or other service providers. Also, alerts may be customized by customers and the AAAS 120 may be configured deliver the customized alert to the requesting customer.

FIG. 3 illustrates an example text-based datalink weather alert sent to a particular aircraft (N510QS, in this instance). As is seen, the alert also indicates the reason that resulted in the alert. For example, in the FIG. 3, the reason is indicated by the line "KHPN WEATHER ALERT THRESHOLD MET OR EXCEEDED." Herein, KHPN refers to the International Civil Aviation Organization airport code (ICAO) of Westchester County Airport, and is the original intended destination of the particular aircraft. The alert also indicates the current and forecast weather at KHPN. The available alternate airports are also identified by their respective ICAO codes. In this case, the alternate airports include KPHL (Philadelphia International Airport) and KBDL (Bradley International Airport).

Referring again to FIGS. 2A and 2B, the RE 122 may process the datalink alert of FIG. 3 and initially display a message such as "DEST APT WEATHER THRESHOLD MET" in a portion of the upper left quadrant in FIG. 2A. The message may be displayed in place of the message "DEST APT CLOSED" and "ALT APT CLOSED" message in FIG. 2A. When the pilot selects the displayed message, the display in the upper right quadrant of the flight display in FIG. 2A will indicate the suggested reroutes, KPHL and KBDL, from the datalink alert. The reroutes, KPHL and KBDL, may be indicated as items [1] and [2] below "Suggested Reroutes" in FIG. 2A. When the pilot selects the "MORE DETAILS" button in the upper right quadrant, the display may change to the display in FIG. 2B, wherein the pilots are provided with the option to load a desired reroute from the suggested reroutes (LOAD 1 and LOAD 2 buttons in FIG. 2B). The display may also include the reasons (reroute justification) for suggesting the reroutes.

According to exemplary embodiments, the alert is not only displayed in the flight deck, but is also communicated to the ATC 131 and/or the flight dispatch 132. The alert may "pop-up" on the screens of the ATC 131 and/or flight dispatch 132 simultaneously, successively or in any desired manner. For example, when the alert is displayed on the screen of the ATC 131, the ATC 131 may either consider the suggested reroutes as acceptable and permit landing on any of the suggested airports or may restrict landing to only one of the suggested airports. For example, instead of exchanging multiple voice messages with the pilot 133 and/or the flight dispatch 132, the ATC 131 may indicate in a communication to modify the routing in view of a flow control imposed by the ATC 131 at the suggested airports. Alternatively, the flight dispatch 132 may indicate in a communication to the pilot 133 to reduce the speed of the aircraft so that by the time the aircraft lands at the suggest reroute airports there is a gate available for the aircraft.

As will be understood, although the output of the AAAS 120 is acted upon individually (or independently) by the ATC 131, the flight dispatch 132, and/or the pilot 133, a final action (for example, updating the trajectory of the aircraft in flight) is a product of a collaborative decision between the ATC 131, the flight dispatch 132, and the pilot 133. No one group (ATC, pilots, flight dispatch) presently has all the information to make the determination independently. For example, ATC 131 does not have the current fuel state of the aircraft, the pilot 133 does not have the view of route congestion, the flight dispatch 132 is not aware of the current weather conditions being experienced in flight.

According to exemplary embodiments, the decision support tools of the DE 121 may include algorithms that may output an alert based on defined rules. In the present context, a rule may refer to conditions pertinent to threat objects that must be satisfied in order to conduct a legal, safe and/or user (customer) desired aircraft operation. A threat object may refer to any physical phenomenon or impediment that would affect normal operation of the flight. For example, the contents of the databases 112, 114, 116, and 118 may be considered as threat objects when determined to impede normal flight operation. The threat objects may be monitored continuously. Accordingly, an alert is issued when any one condition of the rule is not satisfied.

As an example, one may define a rule to include referring to the ILS minimums for each airport, determining the weather from the TAF and/or METAR for each of the airports and determining if the weather is above the ILS minimums. Since a legal landing may be carried out only when the weather is above ILS minimums, this rule may help in determining whether the aircraft can make a safe and legal landing at a desired airport based on the weather conditions prevailing at that airport. This rule may be further modified to include user (customer) and/or pilot preferences. For example, a pilot may prefer to land only when the wind is a certain direction, or when the visibility and/or the ceiling are above the minima specified for an ILS (for example, a pilot be comfortable landing when the ceiling no lower than minimums plus 100 feet). Therefore, even if the weather is above ILS minimum, as legally required for landing, the pilot may choose not to land at that airport if the wind direction is a direction the pilot considers undesirable or if the ceiling is only 50 feet above the minima specified for an ILS. Similarly, the rule may be further modified to include a customer requirement that the landing fees be below a certain cost.

Accordingly, the rules (and the algorithms, correspondingly) may be tailored to evaluate a variety of parameters such as physical conditions (weather, weather minimums, runway conditions, congestion, gate availability, etc.), airplane capabilities (e.g. CAT IIIb, ILS, VFR only, etc.), crew training, crew experience, crew-identified preferences, and company policies. When a threshold level is met or exceeded an alert is automatically generated. As such, by way of a rule, one can tailor the situation that requires an alert. For example, in the above case, not all weather information will result in an alert. An alert will be issued only when the weather goes below ILS minimums.

According to exemplary embodiments, rules may be combined in a manner not previously accomplished. For example, the above rule may be combined with another rule to include checking whether the aircraft is capable of making the flight to the airport, the crew has the necessary training to perform required duties before and after landing, there will be a conflict in the crew duty hours, the pilot and customer preferences are being satisfied or the like. As is understood, the combination of rules can create tailored guidelines or regulations that a civil aviation governing authority (for example, FAA in the U.S.) may never provide.

Furthermore, the rules can be customized as per customer requirements. As such, according to exemplary embodiments, the DE 121 includes different rules sets as per requirement. Also, given that any information from any of the databases 112, 114, 116 and 118 can be used to define the rules, the number of rules that can be defined is practically endless. Advantageously, such a rule combination and customization may further increase the safety of operation, and customer satisfaction.

As mentioned above, the DE 121, based on the rules, may output an alert to the ATC 131, the flight dispatch 132 and/or pilot 133. According to exemplary embodiments, this alert may be issued only if it is deemed relevant. For example, if a temporary flight restriction (TFR) is unexpectedly issued over a certain airspace while the aircraft is in flight, the rules may be configured to determine whether the aircraft will be traversing the restricted airspace during the time of the TFR based on the current flight plan. If the aircraft will be traversing the airspace having the TFR, then an update to the flight plan may be required. If not, then the TFR is of comparatively little significance and may be ignored.

According to exemplary embodiments, the AAAS 120 may evaluate the conditions in a 4-dimensional corridor of interest around the aircraft with focus on portions of the corridor ahead of the aircraft. The fourth dimension may refer to time, and, the AAAS 120 may thus evaluate for threat objects in space and in time. As such, when the AAAS 120 detects a threat object in the corridor of interest, in addition to determining the location of the threat object, the AAAS 120 will also evaluate whether the aircraft will be affected by the detected threat object when the aircraft will be at the determined location of the detected threat object. The corridor of interest may include the environment surrounding the aircraft in flight till a desired distance from the aircraft. As such, an alert causing situation that may develop at a location in the corridor of interest after the aircraft has traversed that location may be considered irrelevant and may be ignored.

Figure 4:
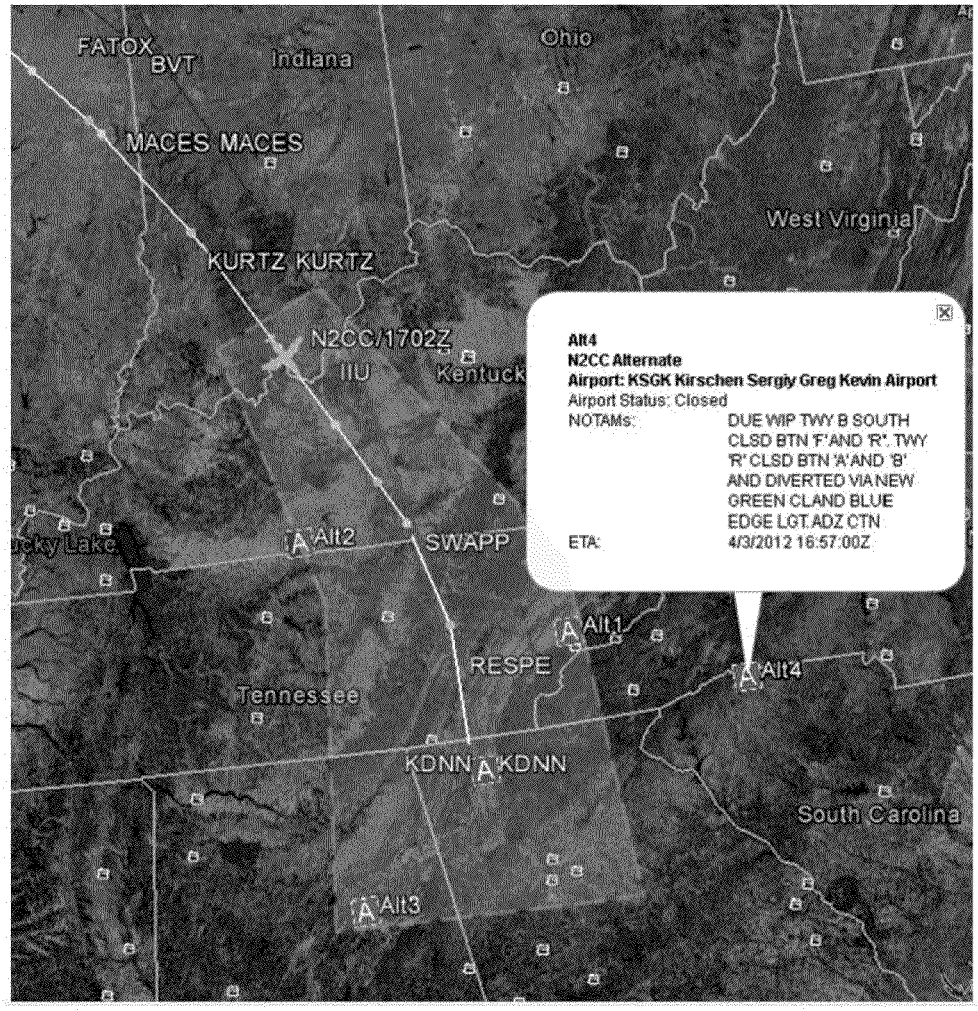
FIG. 4 illustrates a hover over pop-up window displaying the information of an airport, according to exemplary embodiments.

As mentioned above, the AAAS 120 may monitor weather and other conditions at the destination airport and all airports in the vicinity of the destination airport and along with flight path. However, according to exemplary embodiments, an alert regarding an alternate airport may be sent to an aircraft only when it is determined to head towards that alternate airport. Stated otherwise, if it is possible to land the aircraft at the destination airport, no alert about the alternate airport conditions will be issued unless conditions at the original destination airport become unfavorable and it is decided to head to the alternate airport. In this manner, AAAS 120 attempts to maintain the workload of the pilots as reduced as possible. However, the destination and alternate airports are monitored at all times. Further, it should be noted that the pilot may request and obtain the status of any desired airport. For example, the pilot may position the cursor (or hover the cursor) in the flight display over the desired airport and information about the status of the desired airport may be obtained via a pop-up window. FIG. 4 illustrates an example hover over pop-up window displaying information about the status of an airport (for example, alternate airport ALT 4) in the vicinity of the destination airport (KDNN).

According to exemplary embodiments, the RE 122 processes "raw" unprocessed information (for example, textual lists of METARs, TAFs, NOTAMs, etc.) from the databases 112, 114, 116, and 118, and provides the pilots with information at a central location in the flight deck as illustrated, for example, in FIGS. 2A and 2B. In this manner, the pilots do not have to analyze disparate segments of data in different flight displays in order to come to a conclusion about the changes to the flight trajectory. The ATC 131, the flight dispatch 132 and the pilots 133 will then collaborate with each other to come to an agreement on a final acceptable trajectory. Similarly, the "raw" unprocessed information may be processed by the RE 122 and provided to the ATC 131 and/or flight dispatch 132 at a central location so that ATC 131 and/or flight dispatch 132 can efficiently collaborate with the pilots 133 and each other to come to an agreement on final acceptable trajectory.

Figure 5:
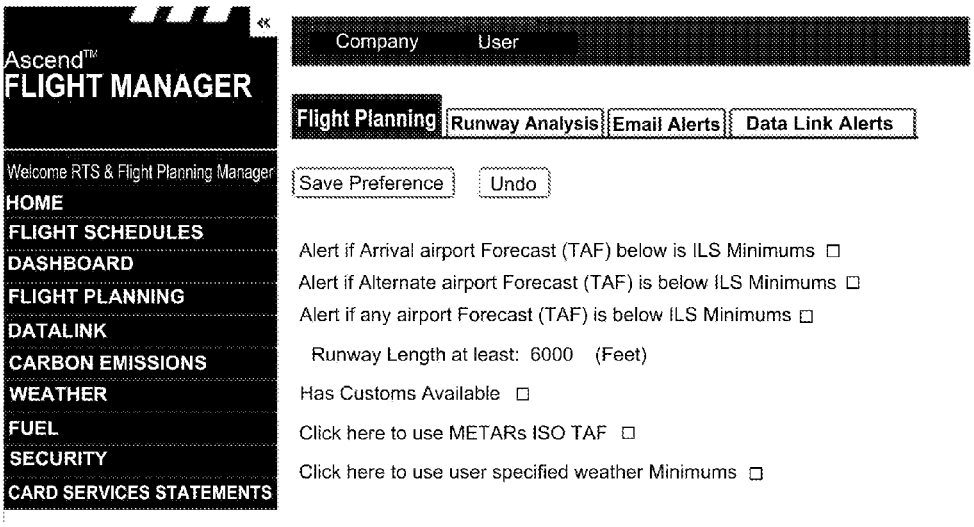
FIG. 5 illustrates one or more user selectable alerts displayed on one or more user interfaces, according to exemplary embodiments.

According to exemplary embodiments, the alerts desired to be issued may be indicated by a user (customer). For example, FIG. 5 illustrates a display on one or more user interfaces 104 communicably connected (for example, via network 108) to the AAAS 120. As illustrated in FIG. 5, a user is able to select the desired alerts(s). The number of user selectable alerts (7) in FIG. 5 is only an example, and the number of user selectable alerts may be expanded to include additional user selectable alerts as required by the application.

Figure 6:
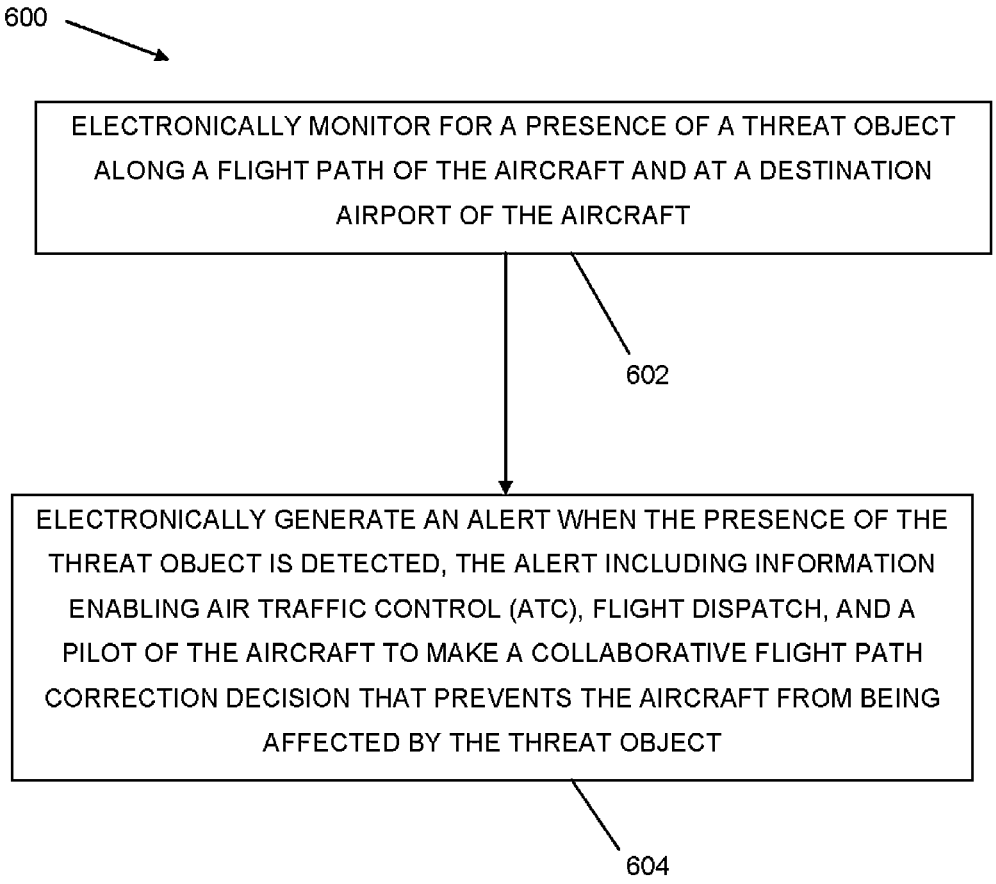
FIG. 6 illustrates a flowchart of a method of managing an aircraft in flight, according to exemplary embodiments.

According to exemplary embodiments, a method 600 of managing an aircraft in flight is provided as illustrated in FIG. 6. The method 600 may include electronically monitoring for a presence of a threat object along a flight path of the aircraft and at a destination airport of the aircraft, as at 602. The method 600 may also include, as at 604, electronically generating an alert when the presence of the threat object is detected. The alert may include information enabling air traffic control (ATC), flight dispatch, and a pilot of the aircraft to make a collaborative flight path correction decision that may prevent the aircraft from being affected by the threat object.

Figure 7:
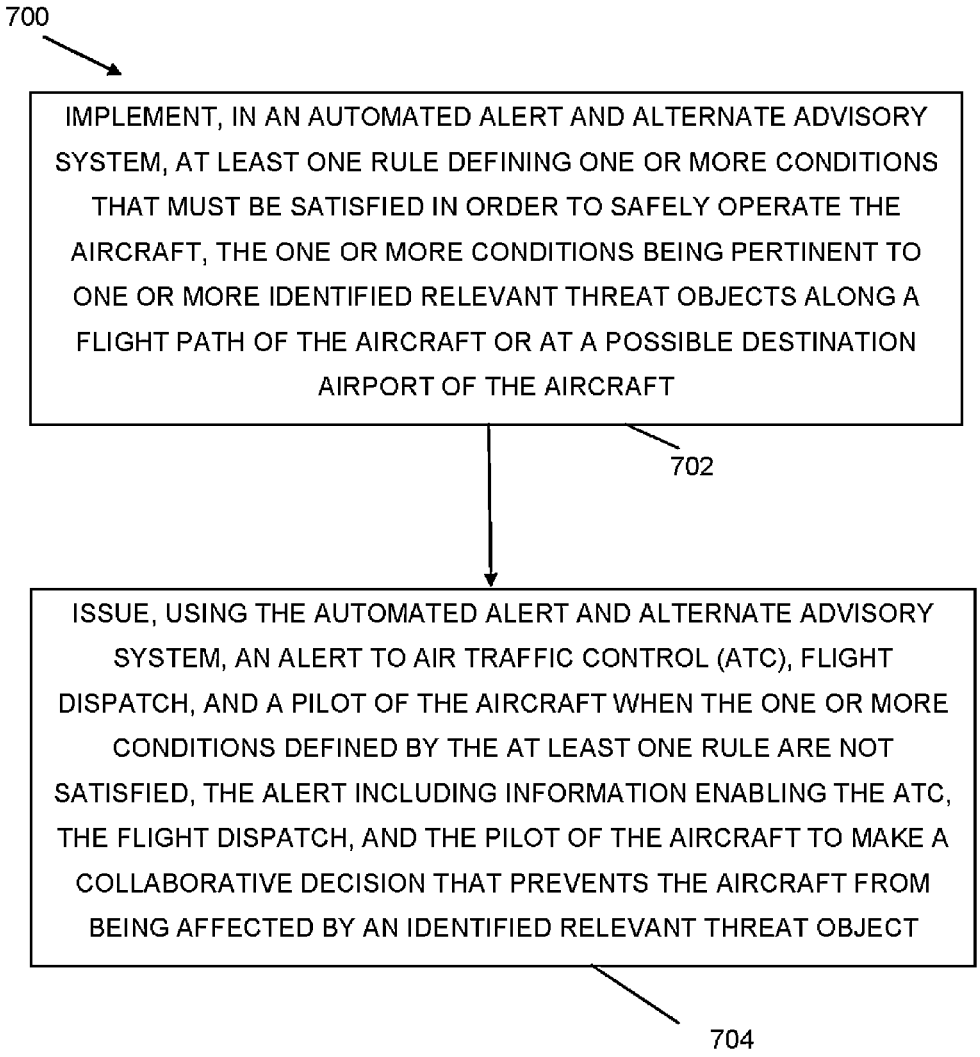
FIG. 7 illustrates a flowchart of a method of managing an aircraft in flight, according to exemplary embodiments.

According to exemplary embodiments, a method 700 of managing an aircraft in flight is provided as illustrated in FIG. 7. The method 700 may include implementing, in an alert and alternate advisory system, at least one rule defining one or more conditions that must be satisfied in order to safely operate the aircraft. The one or more conditions may be pertinent to one or more identified relevant threat objects along a flight path of the aircraft or at a possible destination airport of the aircraft, as at 702. The method 700 may also include, as at 704, issuing, using the automated alert and alternate advisory system, an alert to an air traffic control (ATC), flight dispatch, and a pilot of the aircraft when the one or more conditions defined by the at least one rule are not satisfied. The alert may include information enabling the ATC, the flight dispatch, and the pilot of the aircraft to make a collaborative decision that may prevent the aircraft from being affected by an identified relevant threat object.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. A method of managing an aircraft in flight, comprising:

accessing via a data engine a data structure stored in a forecast weather database and a data structure stored in a current weather database;

compiling via the data engine the data structure of the forecast weather database and the data structure of the current weather database;

processing via the data engine the data structure of the forecast weather database and the data structure of the current weather database to detect for a presence of a threat object along a flight path of the aircraft and at a destination airport of the aircraft; and electronically generating an alert when the presence of the threat object is detected, the alert including information enabling air traffic control (ATC), flight dispatch, and a pilot of the aircraft to make a collaborative flight path correction decision that prevents the aircraft from being affected by the threat object.

2. The method of claim 1, wherein processing via the data engine the data structure of the forecast weather database and the data structure of the current weather database further comprises determining if the threat object exists in a 4-dimensional corridor of interest around the aircraft or ahead of the aircraft.

3. The method of claim 2, wherein the corridor of interest ahead of the aircraft comprises a current aircraft flight path or a flight path corresponding to an alternate airport.

4. The method of claim 3, further comprising evaluating availability of additional alternate airports based on the threat object, wherein the alert includes available alternate airports to reroute the aircraft, a reason for including the available alternate airports, and the threat object that caused the alert.

5. The method of claim 1, wherein the threat object comprises an impediment to normal flight operation of the aircraft.

6. The method of claim 1, further comprising implementing an algorithmic rule having a condition precedent to operate the aircraft, the condition precedent being pertinent to the threat object, and issuing the alert only when the condition precedent is not satisfied.

7. The method of claim 6, wherein the algorithmic rule further comprises a combined rule, wherein each condition in the combined rule must be satisfied to operate the aircraft.

8. The method of claim 7, wherein at least one condition in the combined rule is user defined.

9. The method of claim 1, wherein the alert is sent in a datalink message to the aircraft, the datalink message being specific to the aircraft.

10. A system for managing an aircraft in flight, comprising:

a forecast weather database configured to store and update a first data structure comprising information required to safely operate the aircraft;

a current weather database configured to store and update a second data structure comprising information required to safely operate the aircraft; and an alert and alternate advisory system communicably coupled to the forecast weather database and the current weather database, the alert and alternate advisory system configured to:

access via a data engine the first data structure stored in the forecast weather database and the second data structure stored in the current weather database;

compile via the data engine the first data structure of the forecast weather database and the second data structure of the current weather database;

process via the data engine the first data structure of the forecast weather database and the second data structure of the current weather database to detect for a threat object along a flight path of the aircraft and at a destination airport of the aircraft; and issue an alert to air traffic control (ATC), flight dispatch, and a pilot of the aircraft when the threat object is detected, the alert including information permitting the ATC, the flight dispatch, and the pilot of the aircraft to make a collaborative decision that prevents the aircraft from being affected by the threat object, the threat object being an impediment to normal or safe flight operation.

11. The system of claim 10, wherein the alert and alternate advisory system is further configured to process via the data engine the first data structure of the forecast weather database and the second data structure of the current weather database to detect for the threat object in a 4-dimensional corridor of interest around the aircraft or ahead of the aircraft along a current aircraft flight path or a flight path corresponding to an alternate airport.

12. The system of claim 10, wherein the alert and alternate advisory system is further configured to issue the alert when a condition defined by at least one rule implemented in the alert and alternate advisory system is not satisfied, the condition being pertinent to the threat object.

13. A method of managing an aircraft in flight, comprising:

implementing, in an automated alert and alternate advisory system comprising a data engine, at least one rule defining one or more conditions that must be satisfied in order to safely operate the aircraft, the one or more conditions being pertinent to one or more identified relevant threat objects along a flight path of the aircraft or at a destination airport of the aircraft;

accessing via the data engine a data structure stored in a forecast weather database and a data structure stored in a current weather database;

compiling via the data engine the data structure of the forecast weather database and the data structure of the current weather database;

processing via the data engine, and based on the at least one rule, the data structure of the forecast weather database and the data structure of the current weather database to detect for a presence of the one or more identified relevant threat objects along the flight path of the aircraft and at the destination airport of the aircraft; and issuing, using the automated alert and alternate advisory system, an alert to air traffic control (ATC), flight dispatch, and a pilot of the aircraft when the one or more conditions defined by the at least one rule are not satisfied, the alert including information enabling the ATC, the flight dispatch, and the pilot of the aircraft to make a collaborative decision that prevents the aircraft from being affected by the one or more identified relevant threat objects.

14. The method of claim 13, further comprising:

dynamically evaluating availability of an alternate airport in a vicinity of the destination airport and flight path based on the one or more identified relevant threat objects wherein the alert includes an available alternate airport to reroute the aircraft, provides at least one reason for including the available alternate airport, and the one or more identified relevant threat objects that caused the alert.

15. The method of claim 13, wherein processing via the data engine the data structure of the forecast weather database and the data structure of the current weather database further comprises determining if the one or more identified relevant threat objects exist in a 4-dimensional corridor of interest around and ahead of the aircraft along the flight path.

16. The method of claim 13, wherein the one or more identified relevant threat objects comprise an impediment to normal flight operation of the aircraft.

* * * * *